US011434720B2

(12) United States Patent
Johnson

(10) Patent No.: US 11,434,720 B2
(45) Date of Patent: Sep. 6, 2022

(54) MODIFIABLE THREE POSITION SLEEVE FOR SELECTIVE RESERVOIR STIMULATION AND PRODUCTION

(71) Applicant: Michael H. Johnson, Katy, TX (US)

(72) Inventor: Michael H. Johnson, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/867,356

(22) Filed: May 5, 2020

(65) Prior Publication Data

US 2021/0348474 A1 Nov. 11, 2021

(51) Int. Cl.

| | |
|---|---|
| ***E21B 34/06*** | (2006.01) |
| ***E21B 34/14*** | (2006.01) |
| ***E21B 43/26*** | (2006.01) |
| ***E21B 43/12*** | (2006.01) |

(52) U.S. Cl.

CPC ..... *E21B 34/06* (2013.01); *E21B 34/063* (2013.01); *E21B 34/142* (2020.05); *E21B 43/12* (2013.01); *E21B 43/26* (2013.01); *E21B 2200/06* (2020.05)

(58) Field of Classification Search

CPC ..... E21B 34/06; E21B 23/04; E21B 34/142; E21B 34/14; E21B 43/26; E21B 2200/06; E21B 33/00; E21B 34/063; E21B 34/63

See application file for complete search history.

(56) References Cited

U.S. PATENT DOCUMENTS

| | | | | |
|---|---|---|---|---|
| 7,703,510 | B2 | 4/2010 | Xu | |
| 3,342,245 | A1 | 1/2013 | Richard et al. | |
| 2008/0210429 | A1* | 9/2008 | McMillin | E21B 33/13 166/313 |
| 2009/0056934 | A1 | 3/2009 | Xu | |
| 2010/0212903 | A1 | 8/2010 | Dotson et al. | |
| 2013/0180724 | A1* | 7/2013 | Nguyen | E21B 43/12 166/316 |
| 2014/0216754 | A1* | 8/2014 | Richard | E21B 43/26 166/373 |
| 2019/0055800 | A1* | 2/2019 | Stone | E21B 21/10 |
| 2019/0100980 | A1* | 4/2019 | Fuxa | E21B 21/14 |
| 2019/0136666 | A1 | 5/2019 | Kent | |

FOREIGN PATENT DOCUMENTS

| | | | |
|---|---|---|---|
| CN | 108474252 | A | 8/2018 |
| WO | 2018187854 | A1 | 10/2018 |

OTHER PUBLICATIONS

International Search Report and Written Opinion for International Application No. PCT/US2021/030845; International Filing Date May 5, 2021; dated Aug. 23, 2021; 10 Pages.

* cited by examiner

*Primary Examiner* — George S Gray
(74) *Attorney, Agent, or Firm* — Cantor Colburn LLP

(57) ABSTRACT

A downhole tool and method of use. The downhole tool includes a stimulation sleeve receptive to a stimulation insert, and a production sleeve receptive to a production insert. A formation parameter of the reservoir is obtained. The tool is assembled to include the stimulation sleeve and the production sleeve, which are configured based on the formation parameter. The tool is run downhole into a wellbore to perform a stimulation operation via the stimulation sleeve and a production operation via the production sleeve.

11 Claims, 9 Drawing Sheets

MODIFIABLE THREE POSITION SLEEVE FOR SELECTIVE RESERVOIR STIMULATION AND PRODUCTION

BACKGROUND

In the resource recovery industry, stimulation and production operations are performed in a wellbore. The need for efficiency in resource recovery leads to using downhole equipment suitable for both the stimulation and production operations. Such downhole equipment thus requires an efficient method for switching between various stimulation operations and modes of production operations. Options or possibilities for stimulating certain reservoirs within the same wellbore could include propped fractures, acid fractures, and matrix acidizing. The current invention provides the downhole equipment with the potential for using a multistage completion option which can accommodate each stimulation option selectively in a single wellbore while also having a means of production after stimulating with option for unrestricted production or using filters to capture solids from the production flow stream. Selectable options for stimulation and production with the downhole equipment include:

SUMMARY

An embodiment of a downhole tool, including a stimulation sleeve receptive to a stimulation insert, and a production sleeve receptive to a production insert.

An embodiment of a method of producing a reservoir, including obtaining a formation parameter of the reservoir, assembling a tool having a stimulation sleeve and a production sleeve, configuring at least one of the stimulation sleeve and the production sleeve for the reservoir based on the formation parameter; and running the downhole tool into a wellbore to perform a stimulation operation via the stimulation sleeve and a production operation via the production sleeve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
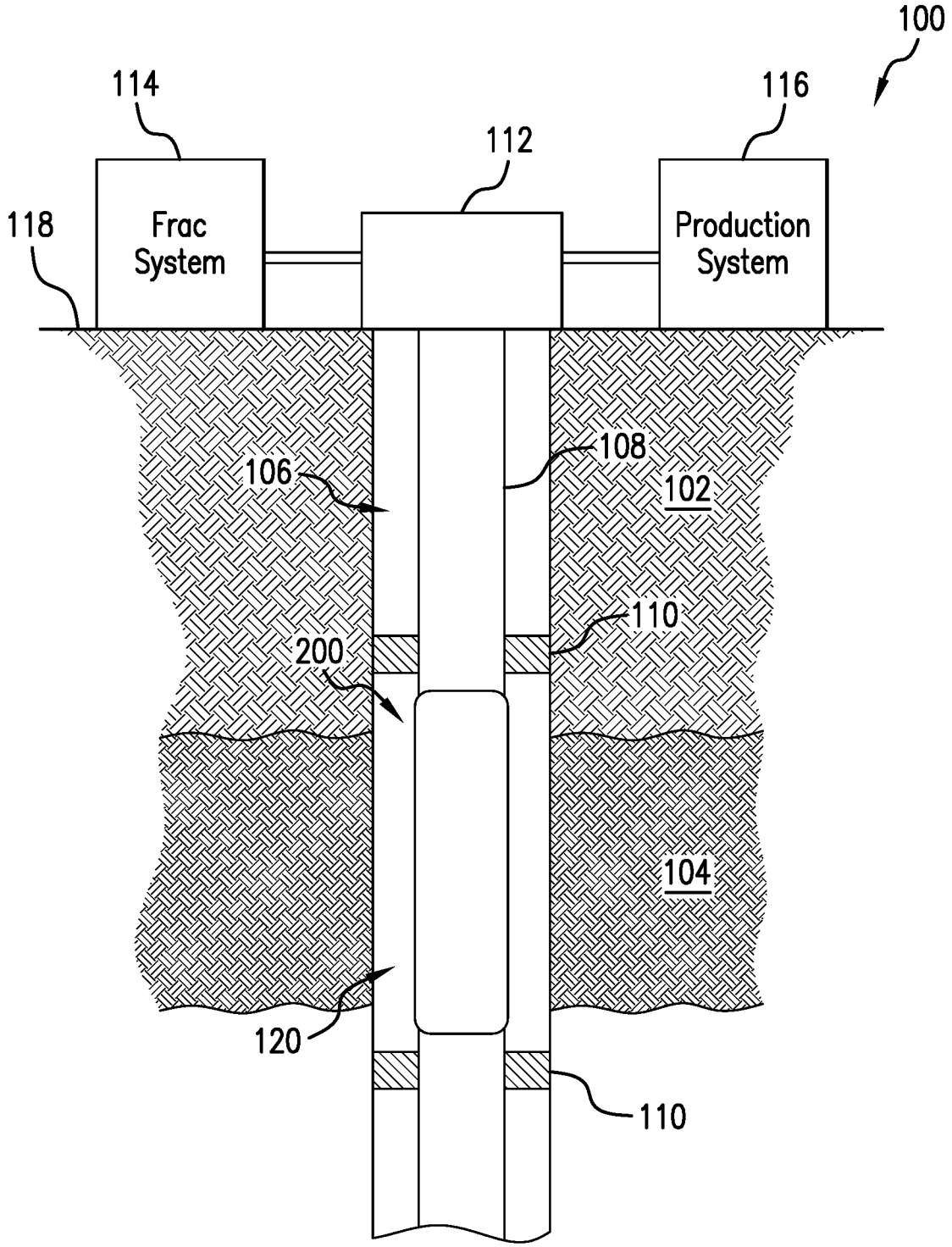
FIG. 1 shows a system for performing fracturing and production operations.

Referring to FIG. 1, a system 100 for performing fracturing and production operations is shown. The system 100 includes a tubular or string 108 that extends from a wellhead 112 at a surface location 118 into a wellbore 106 penetrating a formation 102. The string 108 includes a downhole tool 200 suitable for performing both stimulation operations and production operations downhole. Packers 110 are conveyed by the string 108 and can be activated in the wellbore 106 to isolate a wellbore section 120 proximate a reservoir 104 within the formation 102. At the surface location 118, the wellhead 112 is in communication with stimulation operation equipment 114 as well as production operation equipment 116.

Figure 2:
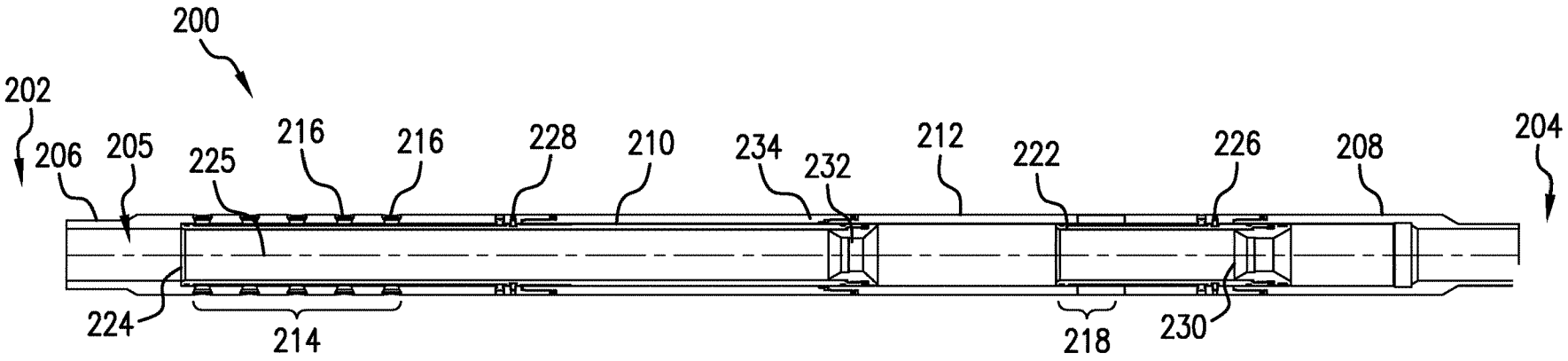
FIG. 2 shows a detailed view of the downhole tool in a first configuration.

FIG. 2 shows a detailed view of the downhole tool 200. The downhole tool 200 extends from a first end 202 to a second end 204 along a longitudinal axis 225. In general, the second end 204 is downhole of the first end 202 when the downhole tool 200 is disposed in the wellbore 106. The downhole tool 200 includes an upper sub 206 proximate the first end 202 and a lower sub 208 near the second end 204. A connector sub 210 connects to a lower end of the upper sub 206. A frac sub 212 connects the connector sub 210 to the lower sub 208. The upper sub 206, lower sub 208, connector sub 210 and frac sub 212 define an inner bore 205 that extends along the longitudinal axis 225. The upper sub 206 includes a production section 215 with a production sleeve 214 having one or more of production ports 216. The frac sub 212 includes a stimulation section 217 including a stimulation sleeve 218 having one or more stimulation ports 220 (shown in FIG. 3).

The downhole tool 200 also includes a first control sleeve or stimulation control sleeve 222 and a second control sleeve or production control sleeve 224, both of which are inner sleeves slidable along the longitudinal axis 225 of the downhole tool 200 within the stimulation section 217 and production section 215, respectively. While the downhole tool 200 is being run into the wellbore 106, the stimulation control sleeve 222 is secured to the to the frac sub 212 via a first set of breakable members 226 in a run-in position that covers the stimulation ports 220 of the stimulation sleeve 218 and the production control sleeve 224 is secured to the upper sub 206 via a second set of breakable members 228 in a run-in position that covers the production ports 216 of the production sleeve 214. In various embodiments, the first set of breakable members 226 and the second set of breakable members 228 includes shear members, shear studs, shear screws or other suitable member that breaks when a force is applied above a selected rupture force of the member(s).

In various embodiments, the stimulation control sleeve 222 is mechanically coupled to a first ball seat 230 slidable within the inner bore 205 of the downhole tool 200. The stimulation control sleeve 222 moves by dropping a first ball onto the first ball seat 230 and then applying a hydraulic pressure from the surface within the inner bore 205 above a pressure that breaks the first set of breakable members 226. Once the first set of breakable members 226 have been broken, the hydraulic pressure moves the stimulation control sleeve 222 from its run-in position to a shifted position nearer the second end 204 of the downhole tool 200. By moving toward the second end 204, the stimulation control sleeve 222 uncovers or exposes the stimulation ports 220 of the stimulation sleeve 218, leaving the stimulation ports 220 in an open position.

Similarly, the production control sleeve 224 is mechanically coupled to a second ball seat 232 slidable within the inner bore 205. In various embodiments, the second ball seat 232 can include a C-ring 234 that secures the second ball seat 232 to the production section 215. The production control sleeve 224 moves by dropping a second ball onto the second ball seat 232 and then applying a hydraulic pressure from the surface within the inner bore 205 above a pressure that breaks the second set of breakable members 228. Once the second set of breakable members 228 have been broken, the hydraulic pressure moves the production control sleeve 224 from its run-in position to a shifted position nearer the second end 204 of the downhole tool 200. The production control sleeve 224 is movable between the run-in position in which it covers the production ports 216 of the production sleeve 214 and a shifted position in which it uncovers or exposes the production ports 216.

FIG. 2 shows the downhole tool 200 in a first configuration (run-in configuration) in which the production control sleeve 224 and the stimulation control sleeve 222 are secured to in place for running the downhole tool 200 into the wellbore 106. In the first configuration, both the production ports 216 of the production sleeve 214 and the stimulation ports 220 of the stimulation sleeve 218 are covered or closed.

Figure 3:
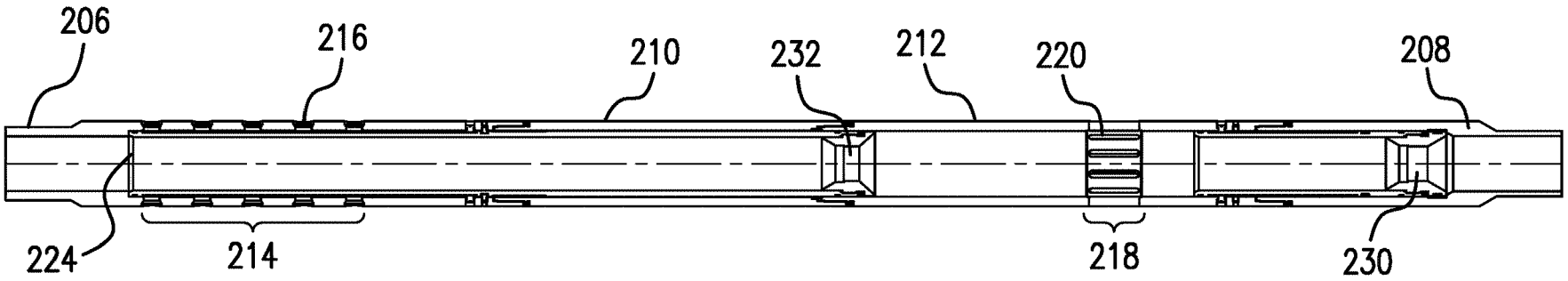
FIG. 3 shows a second configuration of the downhole tool.

FIG. 3 shows a second configuration 300 (a stimulation configuration) of the downhole tool 200. In the second configuration, the stimulation control sleeve 222 is moved toward the second end 204 of the downhole tool 200, while the production control sleeve 224 remains in its run-in position. Thus, the stimulation ports 220 are exposed or uncovered and the production ports 216 are covered or closed in the second configuration.

Figure 4:
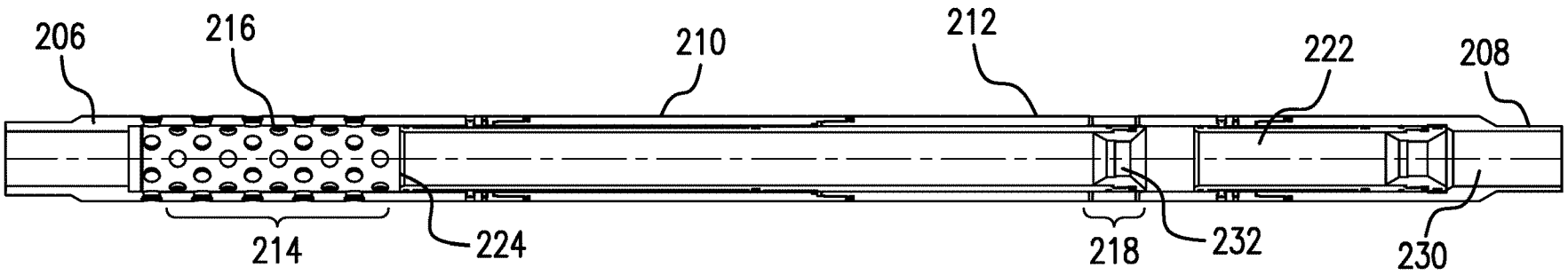
FIG. 4 shows a third configuration of the downhole tool.

FIG. 4 shows a third configuration 400 (a production configuration) of the downhole tool 200. In the third configuration, the production control sleeve 224 has moved along the downhole tool 200 to cover or close the stimulation ports 220. In the process, the production control sleeve 224 at least partially exposes the stimulation section 217 (i.e., exposes some but not all of the stimulation ports 220). In various embodiments, the C-ring 324 of the second ball seat 232 can become stuck in the stimulation ports 220. However, by applying enough hydraulic pressure, the production control sleeve 224 can be moved fully downhole.

Figure 5:
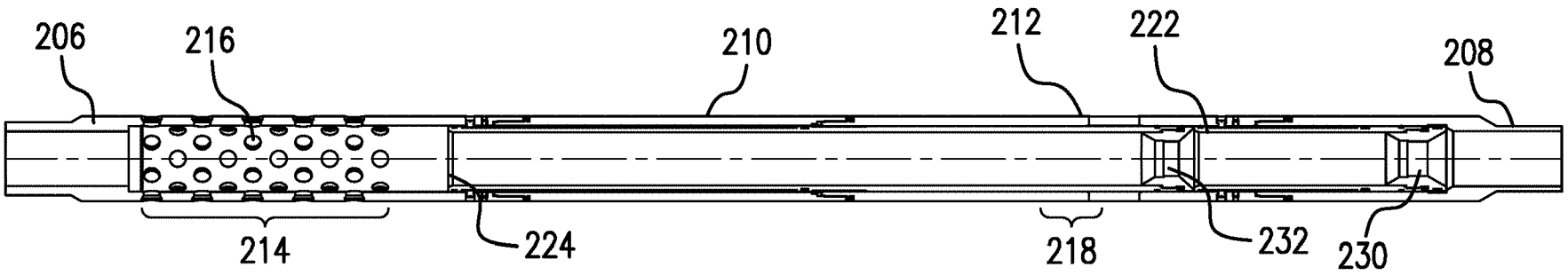
FIG. 5 shows a second version of the third configuration of the downhole tool.
Figure 6:
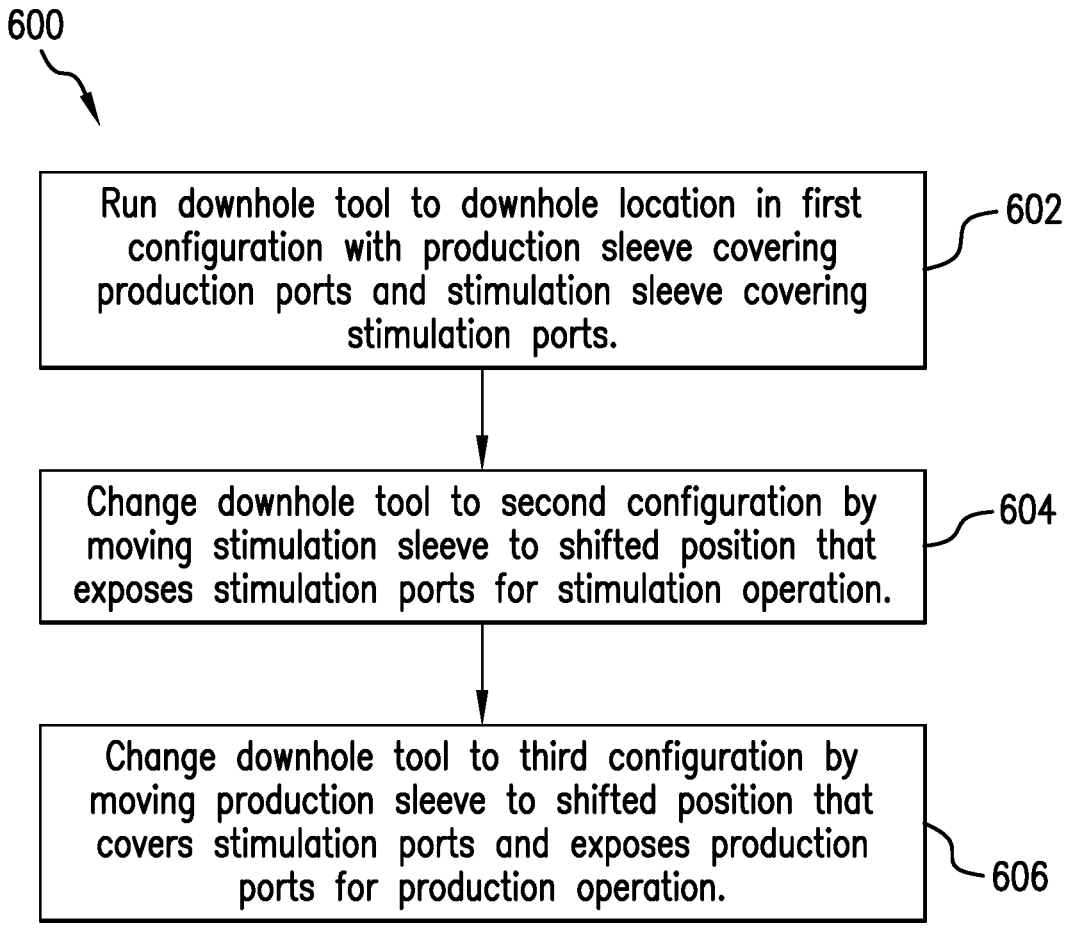
FIG. 6 shows a flowchart illustrating a method of operating the downhole tool in one embodiment.

FIG. 5 shows a second version 500 of the third configuration of the downhole tool 200 in which the production control sleeve 224 has been moved fully downhole and is in contact or nearly in contact with the stimulation control sleeve 222 in its shifted position. FIG. 6 shows a flowchart 600 illustrating a method of operating the downhole tool in one embodiment. In box 602, the downhole tool is run downhole in the first configuration. The production control sleeve 224 and the stimulation control sleeve 222 are secured in place to the downhole tool 200, with production control sleeve 224 covering the production ports 216 of the production sleeve 214 and the stimulation control sleeve 222 covering the stimulation ports 220 of the stimulation sleeve 218.

In box 604, the downhole tool 200 is placed into the second configuration in order to perform a stimulation operation. In particular, the stimulation control sleeve 222 is moved to expose the stimulation ports 220 of the stimulation sleeve 218, allowing for the stimulation fluid or frac fluid to be introduced into the reservoir 104 via the stimulation ports 220. The downhole tool 200 is placed in the second configuration after the downhole tool has been placed in its downhole location proximate the reservoir 104.

In box 606, the downhole tool 200 is placed in the third configuration in order to stop the stimulation operation and commence the production operation. The production control sleeve 224 is moved in order to cover the stimulation ports 220 of the stimulation sleeve 218, in the process, to expose the production ports 216 of the production sleeve 214. Thus, in the third configuration, the stimulation operation is ended as the stimulation ports 220 are closed and fluid is allowed to flow from the reservoir 104 into the downhole tool 200.

In various embodiments, the stimulation ports 220 can be openings in the stimulation sleeve 218 into which various stimulation attachments or inserts can be attached. The stimulation ports 220 can be threaded ports receptive to a threaded stimulation insert or slots into which the stimulation insert can be placed. The stimulation insert can be selected based on a formation parameter measured downhole. The stimulation insert can be selected and attached to the stimulation port at the wellhead 112 before running the work string downhole. In various configurations, one or more stimulation ports 220 can be run downhole without any stimulation inserts.

The production ports 216 can be openings in the production sleeve 214 into which various production attachments or inserts can be attached. The production ports 216 can be threaded ports receptive to a threaded production insert or slots into which the production insert can be placed. The production insert can be selected based on a formation parameter measured downhole. The production insert can be selected and attached to the stimulation port at the wellhead 112 before running the work string downhole. In various configurations, one or more of the production ports 216 can be run downhole without production inserts. The downhole tool 200 can include the production sleeve receptive to production insert, a stimulation sleeve receptive to a stimulation insert, or both.

Figure 7:
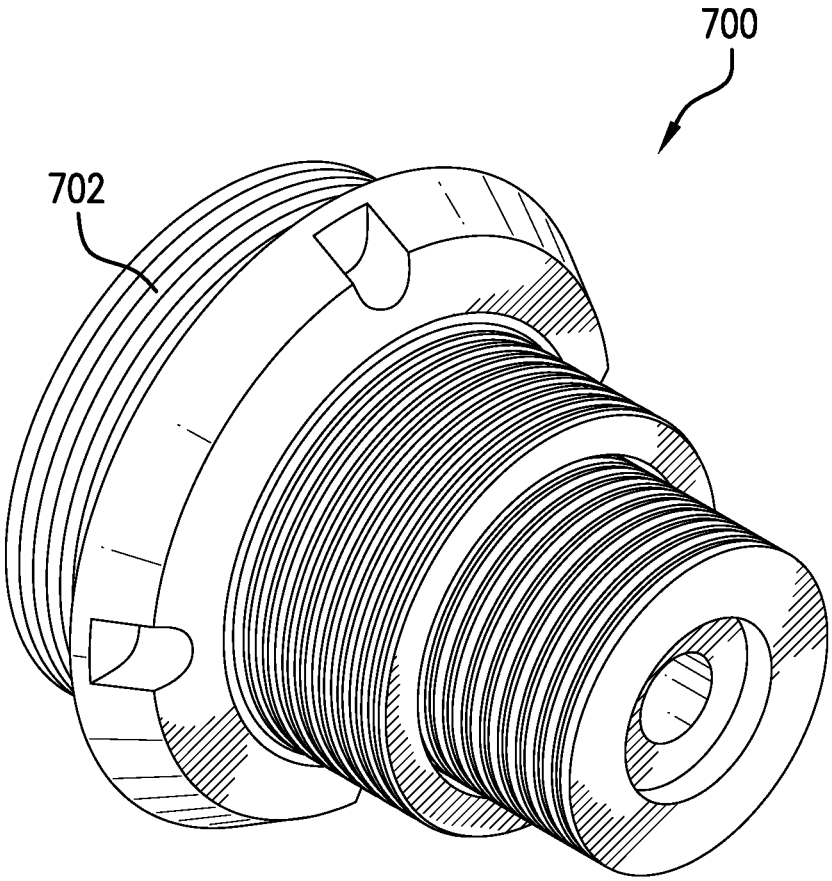
FIG. 7 shows a nozzle that can be used as a stimulation insert to allow fluid to pass out of the stimulation section of the tool.

FIG. 7 shows a nozzle 700 that can be used as stimulation inserts to allow fluid to pass out of the stimulation section of the tool. The nozzle 700 includes a threaded section 702 that can be used to couple the nozzle to the stimulation port. The nozzle 700 can include a recessed configuration and an extended configuration, as illustrated in FIG. 8.

Figure 8A:
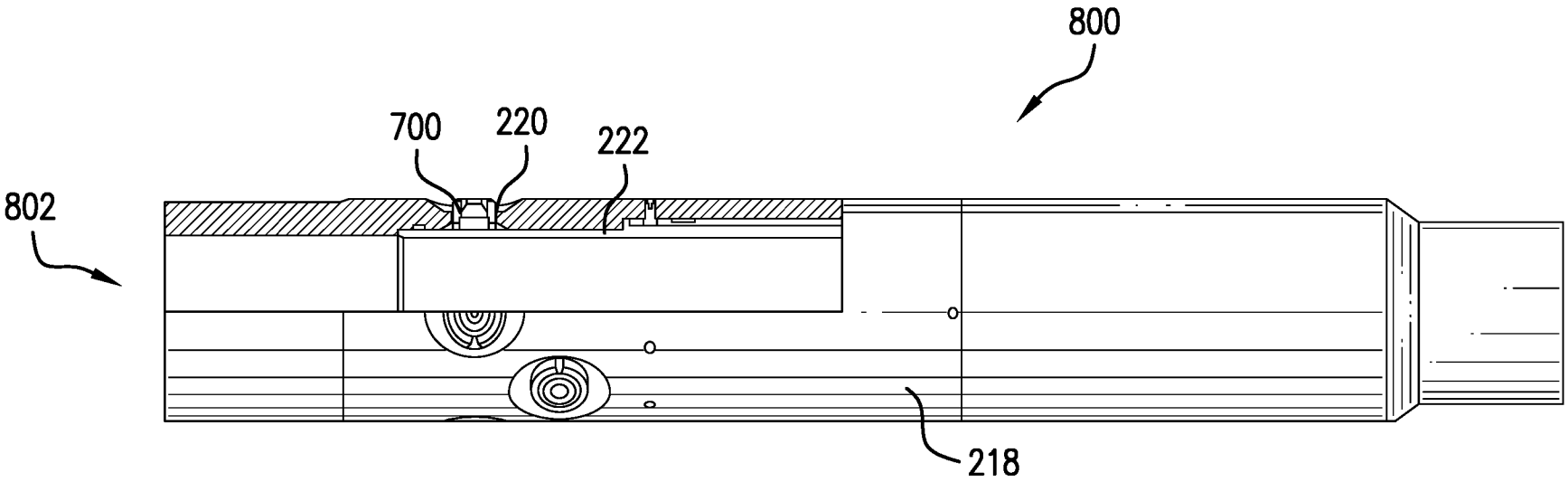
FIGS. 8A and 8B show a close-up of a stimulation sleeve having stimulation inserts.
Figure 8B:
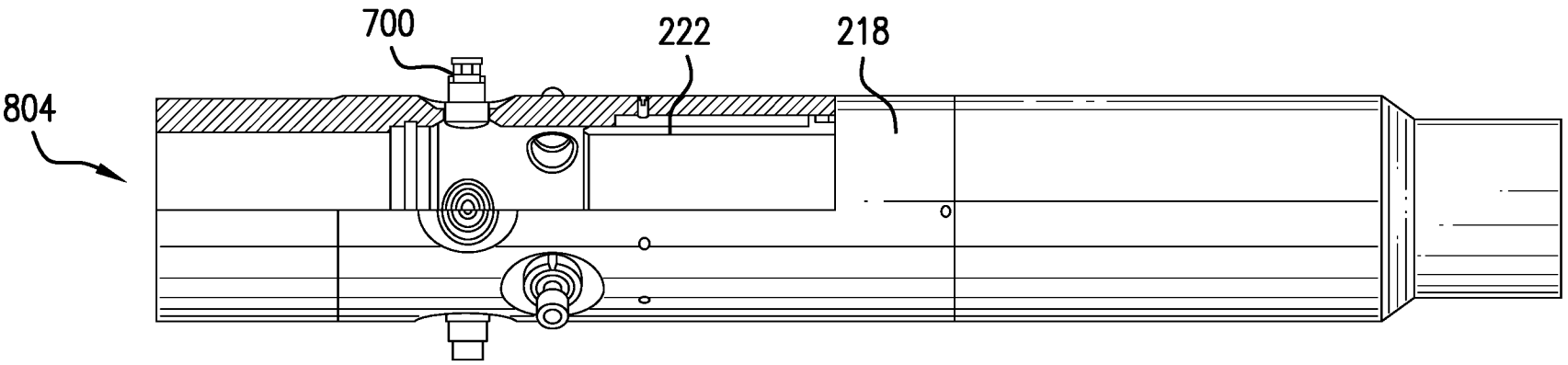

FIGS. 8A and 8B show a close-up of a stimulation sleeve 218 having a stimulation inserts. The stimulation sleeve 218 is shown in both a run-in configuration 802 (FIG. 8A) and a stimulation configuration 804 (FIG. 8B). Nozzles 700 serve as the stimulation inserts are attached within respective stimulation ports 220. In the run-in configuration, the stimulation control sleeve 222 is in a position that closes the stimulation ports 220. In addition, the nozzles 700 are receded into their respective stimulation ports 220. In the stimulation configuration 804, the stimulation control sleeve 222 is in a position that exposes the stimulation ports 220. In addition, nozzles 700 extend from their respective stimulation ports 220 in order to be placed next to the surrounding formation.

Figure 9:
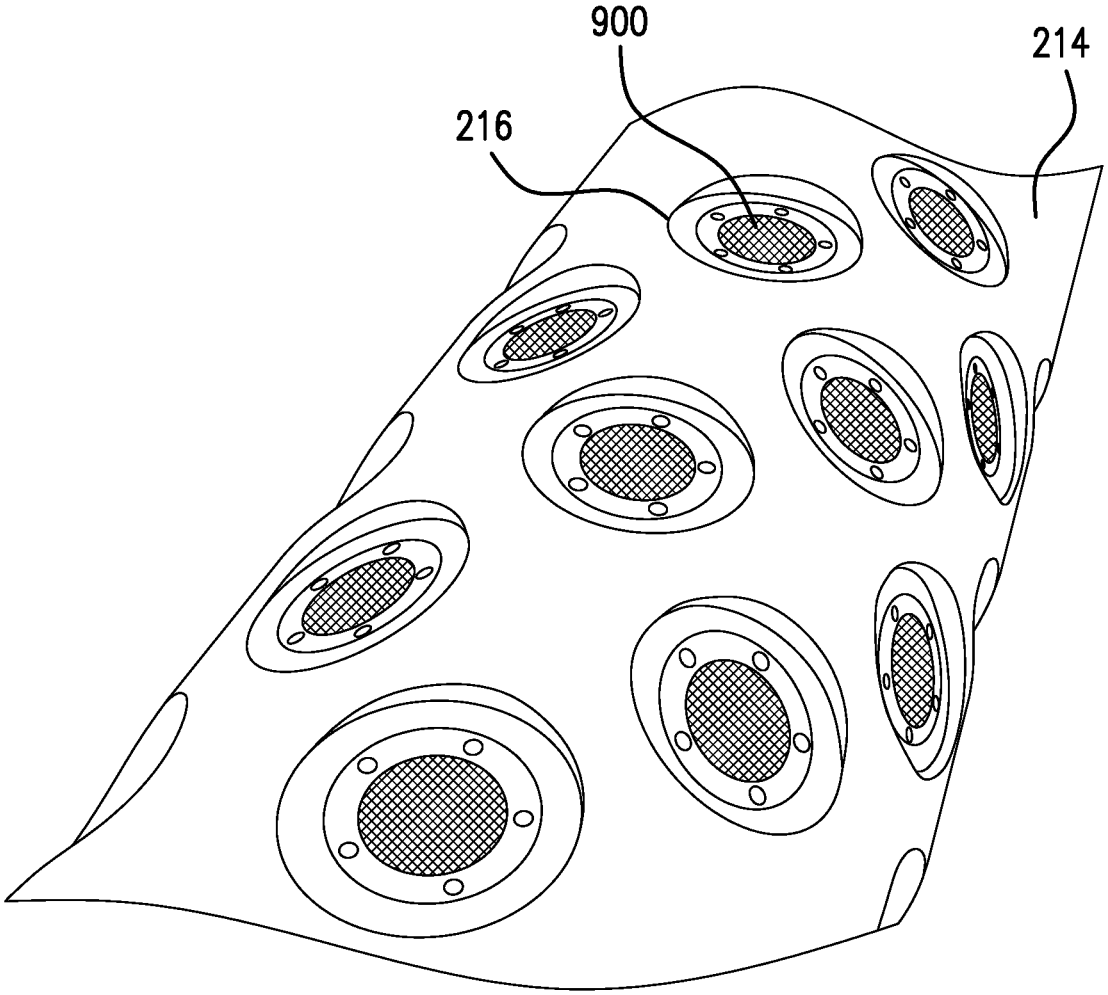
FIG. 9 shows a close-up of a production sleeve with screen inserts in the production ports.

FIG. 9 shows a close-up of a production sleeve 214 with screen inserts 900 in the production ports 216. The screen inserts 900 can be threadingly attached to the production ports 216 using the same methods disclosed herein with respect to the stimulation inserts.

The production sleeve (and production ports) and the stimulation sleeve and configuration ports can be assembled or configured at a surface location or production platform at a wellhead. In various embodiments, a formation parameter can be determined for a location in a wellbore. The formation parameter can be used to select the configuration for at least one of the production sleeve and the stimulation sleeve. The stimulation sleeve can be assembled based on the formation parameter and attached to a top end of the work string. For example, the stimulation sleeve can be configured and assembled onto the lower sub 208 and the production sleeve can be configured and assembled onto the connector sub 210.

The formation parameter can indicate an option for stimulation, such as a matrix acid stimulation without proppant, acid frac stimulation without proppant, acid frac stimulation with proppant, or proppant frac injection. The stimulation option indicates the type of stimulation insert, if any, to attach to the stimulation port. Similarly, the formation parameter can indicate an option for production, such as using an open port or a solids control device such as a screen. The formation parameter indicates the type of production insert, if any, to attach to the production port. Set forth below are some embodiments of the foregoing disclosure:

Embodiment 1: A downhole tool, including a stimulation sleeve receptive to a stimulation insert, and a production sleeve receptive to a production insert.

Embodiment 2: The downhole tool as in any prior embodiment, wherein the stimulation sleeve includes a stimulation port receptive to the stimulation insert.

Embodiment 3: The downhole tool as in any prior embodiment, wherein the stimulation insert is a nozzle.

Embodiment 4: The downhole tool as in any prior embodiment, wherein the production sleeve includes a production port receptive to the production insert.

Embodiment 5: The downhole tool as in any prior embodiment, wherein the production insert is a screen.

Embodiment 6: The downhole tool as in any prior embodiment, further comprising a first control sleeve for opening and closing a stimulation port of the stimulation sleeve and a second control sleeve for opening and closing a production port of the production sleeve.

Embodiment 7: The downhole tool as in any prior embodiment, wherein the first control sleeve covers the stimulation sleeve and the second control sleeve covers the production sleeve in a first configuration of the downhole tool, the first control sleeve exposes the stimulation sleeve and the second control sleeve covers the production sleeve in a second configuration, and the second control sleeve covers the stimulation sleeve and exposes the production sleeve in a third configuration.

Embodiment 8: The downhole tool as in any prior embodiment, wherein the production port is one of completely and partially exposed when the downhole tool is in the third configuration.

Embodiment 9: A method of producing a reservoir, including obtaining a formation parameter of the reservoir, assembling a tool having a stimulation sleeve and a production sleeve, configuring at least one of the stimulation sleeve and the production sleeve for the reservoir based on the formation parameter; and running the downhole tool into a wellbore to perform a stimulation operation via the stimulation sleeve and a production operation via the production sleeve.

Embodiment 10: The method as in any prior embodiment, wherein configuring the stimulation sleeve comprises attaching a stimulation insert to a stimulation port of the stimulation sleeve based on the formation parameter.

Embodiment 11: The method as in any prior embodiment, wherein the stimulation insert is a nozzle.

Embodiment 12: The method as in any prior embodiment, wherein configuring the production sleeve comprises attaching a production insert to a production port of the production sleeve based on the formation parameter.

Embodiment 13: The method as in any prior embodiment, wherein the production insert is a screen.

Embodiment 14: The method as in any prior embodiment, further comprising operating a first control sleeve to open and close a stimulation port of the stimulation sleeve and a second control sleeve to open and close a production port of the production sleeve.

Embodiment 15: The method as in any prior embodiment, wherein the first control sleeve covers the stimulation sleeve and the second control sleeve covers the production sleeve in a first configuration of the downhole tool, the first control sleeve exposes the stimulation sleeve and the second control sleeve covers the production sleeve in a second configuration, and the second control sleeve covers the stimulation sleeve and exposes the production sleeve in a third configuration.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool for use in a wellbore, comprising:

a stimulation sleeve having a plurality of stimulation ports, wherein at least one of the plurality of stimulation ports is receptive to a stimulation insert;

a production sleeve having a production port receptive to a screen; and a production control sleeve slidable with respect to the production sleeve to a longitudinally fixed position in which the production control sleeve exposes the screen of the production sleeve and partially exposes the plurality of stimulation ports.

2. The downhole tool of claim 1, wherein the stimulation insert is a nozzle.

3. The downhole tool of claim 1, further comprising a stimulation control sleeve for opening and closing the stimulation port of the stimulation sleeve.

4. The downhole tool of claim 3, wherein the stimulation control sleeve covers the stimulation sleeve and the production control sleeve covers the production sleeve in a first configuration of the downhole tool, the stimulation control sleeve exposes the stimulation sleeve and the production control sleeve covers the production sleeve in a second configuration, and the production control sleeve partially covers the stimulation sleeve and exposes the production sleeve in the longitudinally fixed configuration.

5. The downhole tool of claim 1, wherein the stimulation insert is selected for a stimulation operation determined for a formation parameter of a formation of the wellbore and the screen is selected for a production operation determined for the formation parameter.

6. The downhole tool of claim 1, wherein the stimulation insert is inserted into the stimulation port and the screen is inserted into the production port at a wellhead of the wellbore.

7. A method of producing a reservoir, comprising:

conveying a tool into wellbore, the tool including a stimulation sleeve having a plurality of stimulation ports, wherein at least one of the plurality of stimulation ports is receptive to a stimulation insert, a production sleeve having a production port receptive to a screen, and a production control sleeve;

performing a stimulation operation via the stimulation sleeve with the production control sleeve covering the production port;

sliding the production control sleeve with respect to the production sleeve to a longitudinally fixed position in which the production control sleeve exposes the screen of the production sleeve and partially exposes the plurality of stimulation ports; and performing a production operation via the production sleeve with the plurality of simulations ports remaining partially exposed.

8. The method of claim 7, wherein the stimulation insert is a nozzle.

9. The method of claim 7, further comprising operating a stimulation control sleeve to open and close the stimulation port of the stimulation sleeve.

10. The method of claim 9, wherein the stimulation control sleeve covers the stimulation sleeve and the production control sleeve covers the production sleeve in a first configuration of the downhole tool, the stimulation control sleeve exposes the stimulation sleeve and the production control sleeve covers the production sleeve in a second configuration, and the production control sleeve partially covers the stimulation sleeve and exposes the production sleeve in the longitudinally fixed configuration.

11. The method of claim 7, further comprising:

obtaining a formation parameter of the reservoir;

determining a stimulation option and a production operation indicated by the formation parameter;

selecting a stimulation insert for the stimulation option and a screen for the production operation; and attaching the stimulation insert to the stimulation port and the screen to the production port at a wellhead of the wellbore.

* * * * *